US005248245A

United States Patent [19]

Behnke et al.

[11] Patent Number: 5,248,245

[45] Date of Patent: Sep. 28, 1993

[54] MAGNETICALLY COUPLED CENTRIFUGAL PUMP WITH IMPROVED CASTING AND LUBRICATION

[75] Inventors: Paul W. Behnke; Richard F. Gussert, both of Bethlehem, Pa.

[73] Assignee: Ingersoll-Dresser Pump Company, Liberty Corner, N.J.

[21] Appl. No.: 970,421

[22] Filed: Nov. 2, 1992

[51] Int. Cl.[5] ..... F04B 17/00

[52] U.S. Cl. ..... 417/366; 417/369; 417/420; 415/110; 415/170.1

[58] Field of Search ..... 417/366, 369, 370, 372, 417/420, 423.1, 423.8, 423.13; 415/110, 111, 170.1, 172.1

[56] References Cited

U.S. PATENT DOCUMENTS

| | | | |
|---|---|---|---|
| 3,115,841 | 12/1963 | Tilson . | |
| 3,225,698 | 12/1965 | Spisiak | 417/369 |
| 4,047,847 | 9/1977 | Oikawa | 417/420 |
| 4,080,112 | 3/1978 | Zimmermann | 417/420 |
| 4,207,485 | 6/1980 | Silver | 310/104 |
| 4,780,066 | 10/1988 | Hauenstein | 417/420 |
| 4,838,763 | 6/1989 | Krämer et al. | 417/420 |
| 4,850,818 | 7/1989 | Kotera | 417/366 |
| 4,871,301 | 10/1989 | Buse | 417/420 |
| 5,017,102 | 5/1991 | Shimaguchi et al. | 417/420 |
| 5,160,246 | 11/1992 | Horiuchi | 417/420 |

OTHER PUBLICATIONS

Heald, Behnke & Gussert, "Development and Qualification of a Magnetically Coupled Process Pump for API 610 7th Edition Services", Proceedings of the Ninth International Pump Users Symposium, 1992.

*Primary Examiner*—Richard A. Bertsch
*Assistant Examiner*—Alfred Basichas
*Attorney, Agent, or Firm*—Michael H. Minns

[57] ABSTRACT

A magnetically coupled centrifugal pump comprising a pump housing containing a pumping chamber and having an inlet and an outlet, a shaft mounted in the pump housing for rotation, a pump impeller attached to the forward end of the shaft for rotation with the shaft in the pumping chamber and a first magnet attached to the rear end of the shaft, the first magnet adapted to be magnetically coupled to a second magnet rotated by a rotary driving device, the shaft being mounted in at least two bearings spaced from each other along the length of the shaft and located between the impeller and the first magnet, a shell surrounding the shaft bearings and first magnet to seal the pump from the exterior and prevent the pumped fluid from leaking, the shell being located between the two magnets and being able to transmit magnet forces between the two magnets for magnetically coupling the two magnets together, the pump housing containing a passage for conducting cooling fluid from the discharge of the pump impeller to the bearings and the shell, the passage dividing the cooling flow into parts such that the cooling fluid cools the bearings and the shell in parallel.

10 Claims, 1 Drawing Sheet

MAGNETICALLY COUPLED CENTRIFUGAL PUMP WITH IMPROVED CASTING AND LUBRICATION

BACKGROUND OF THE INVENTION

This invention relates generally to magnetically coupled pumps, known as a "sealless pump" and more particularly to the use of pumped liquid to lubricate the bearings and to cool the area surrounding the magnets.

A sealless pump is a type of centrifugal pump that has its impeller and bearing system isolated from the impeller driving mechanism by an isolating wall or shell that seals the pumping mechanism from the surrounding environment and eliminates the necessity to use rotary seals to seal the pumped fluid against leaking along the shaft. This type of pump is particularly desirable when pumping environmentally sensitive fluids such as hydrocarbons. The driving mechanism is coupled to the pump impeller by an arrangement of magnets located on the opposite sides of the isolating wall which magnetically connects the torque of the driving mechanism to the impeller.

The magnetically coupled pump designs produced today use the pumped liquid to lubricate the bearings and to cool the area surrounding the magnets. Cooling of the magnet area is required because eddy current losses in metallic primary containment shells generate heat. The amount of heat generated by the eddy current losses is a function of the containment shell material and thickness, with nonmetallic shells eliminating these losses. Approximately one-half of this heat is transferred from the shell by convection to the pumpage circulated through the magnet area.

Internal circulation is typically either from discharge to discharge pressure, utilizing an internal pumping device, or from discharge to suction pressure, where, because of the heat acquired by the circulating flow, problems with flashing in the magnet area or in the impeller inlet may occur.

The foregoing illustrates limitations known to exist in present magnetically coupled centrifugal pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a magnetically coupled centrifugal pump comprising a pump housing containing a pumping chamber and having an inlet and an outlet, a shaft mounted in the pump housing for rotation, a pump impeller attached to the forward end of the shaft for rotation with the shaft in the pumping chamber and a first magnetic means attached to the rear end of the shaft, the first magnetic means adapted to be magnetically coupled to a second magnetic means rotated by a rotary driving device, the shaft being mounted in at least two bearings spaced from each other along the length of the shaft and located between the impeller and the first magnetic means, a shell surrounding the shaft bearings and first magnetic means to seal the pump from the exterior and prevent the pumped fluid from leaking, the shell being located between the two magnetic means and being able to transmit magnet forces between the two magnetic means for magnetically coupling the two magnetic means together, the pump housing containing a passage for conducting cooling fluid from the discharge of the pump impeller to the bearings and the shell, the passage dividing the cooling flow into parts such that the cooling fluid cools the bearings and the shell in parallel.

The foregoing and other aspects will become apparent from the following detailed description of the invention when considered in conjunction with the accompanying drawing figures.

BRIEF DESCRIPTION OF THE DRAWING FIGURES

FIG. 1 is a cross-section of magnetically coupled centrifugal pump.

DETAILED DESCRIPTION

Figure 1:
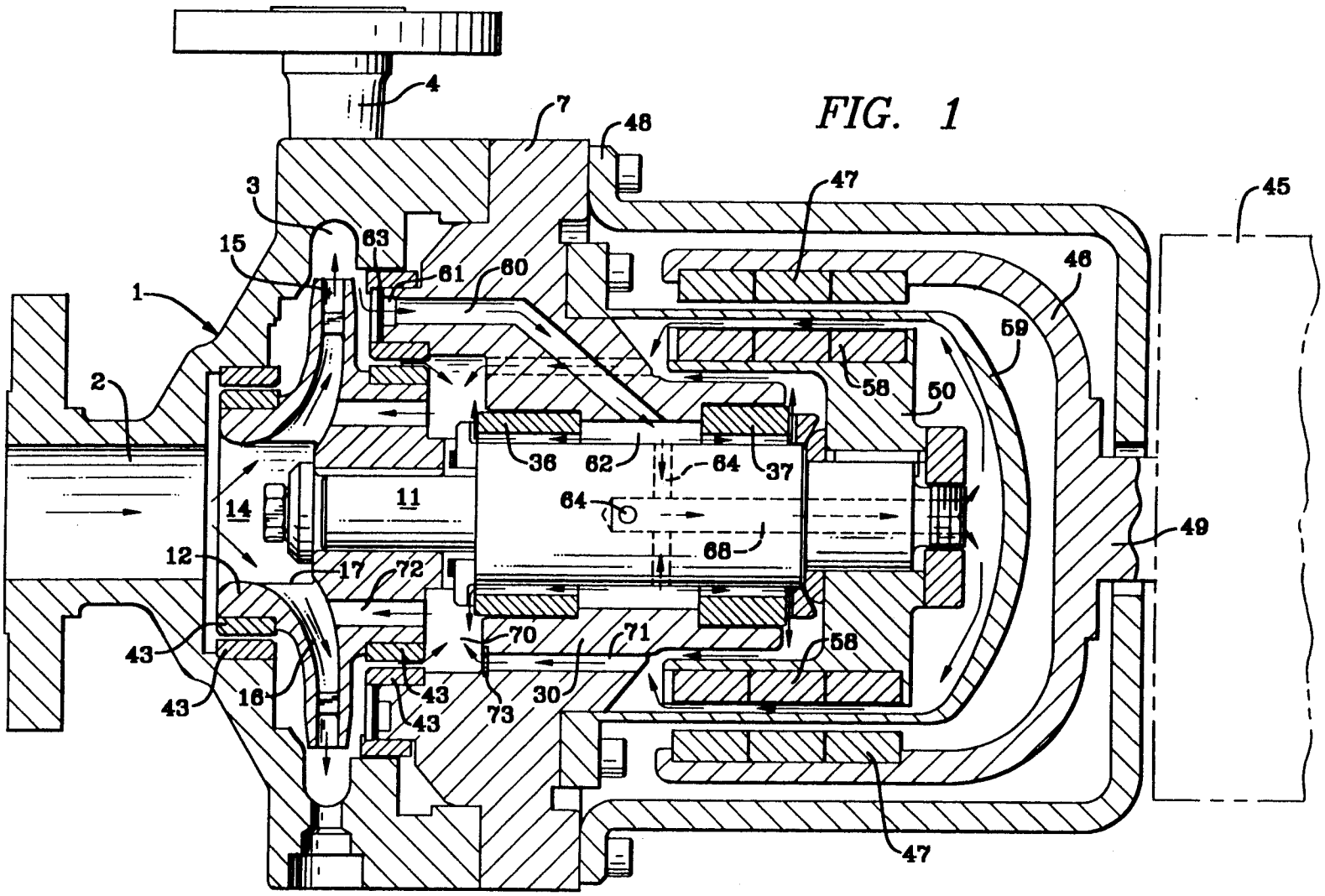

During operation of a magnetically coupled centrifugal pump of the present invention, fluid flow is circulated to the pump bearings and magnets from a high pressure area near the outside diameter of the pump impeller. The pressure at this location in the pump is normally 75 to 80 percent of the total head generated by the pump. After the flow passes through a self-cleaning strainer, it enters a cavity between two product lubricated pump bearings. The flow is then split into three parallel paths. Each bearing is lubricated with cool fluid. The fluid has not previously been used to cool the magnet area, thereby minimizing the danger of creating a flashing situation in the pump bearing area.

The three parallel flow paths are as follows:

Parallel path 1: Approximately one-quarter of the total circulation flow is directed through the front bearing clearance to a cavity below the wear ring diameter at the rear of the impeller. This flow is used for the lubrication of the bearing faces. It also removes the relatively small amount of heat generated by the loaded bearing surfaces. A substantial pressure differential between the two areas creates a significant volume of flow through the bearing.

Parallel path 2: The second parallel path starts out in a manner very similar to the first, in that it is used to lubricate and cool the rear bearing. This flow volume is also approximately one-quarter of the total volume of cooling circulation flow. After it passes through the bearing, however, this flow mixes with the flow from parallel path 3 in the containment shell before entering a passage leading to the area where the combined flow mixes with flow from parallel path 1 and wear ring leakage.

Parallel path 3: The remaining cooling circulation flow volume (about one-half of the total flow) is passed through a drilled passage in the impeller shaft which leads to the rear of the containment shell. Here, it picks up the heat created by eddy-current losses in the shell before mixing with the flow from parallel path 2 and entering a passage leading to the area where it mixes with the flow from parallel path 1 and wear ring leakage.

The temperature rise in the area where the flows are mixed represents the key to the success of the circulation described above. The entire cooling circulation flow volume terminates in the mixing area, after providing lubrication and cooling in the containment shell area. A common perception is that high temperature fluid is flowing to suction pressure. Obviously, if this were to occur, the pump net positive suction head required would have to increase to suppress flashing of the higher temperature liquid. In severe temperature rise instances, even pump minimum flow might have to be increased to avoid cavitation in the impeller inlet.

With the arrangement described here, the assumption that high temperature fluid is being returned to suction pressure is not correct, for two very important reasons. First, the return fluid holes in the impeller are located in the impeller passage at a diameter greater than the diameter of the impeller vane tips. This means that some head, or pressure, has already been generated by the impeller, and the pressure in the mixing area is actually higher than suction pressure by approximately 12 percent of the total discharge head.

Secondly, there is substantial volume of flow through the back impeller wear ring clearance. This leakage flow is typically three to five times greater than the total circulation flow volume through the pump bearing and magnet area. Therefore, it is the dominant factor in determining the temperature in the mixing area. In a test performed on a 3×4×10 test pump, it was determined that the actual temperature in the mixing area was only about one degree (F) above the injection temperature.

The magnetically coupled centrifugal pump shown in FIG. 1 includes a pump casing 1 containing an axial inlet 2, a pumping chamber 3 and an outlet 4, all of which are interconnected by passages extending through the casing 1. The pump casing 1 has an annular flange surrounding the pumping chamber 3. A casing cover 7 is bolted to the annular flange on the pump casing 1. The pump casing 1 and casing cover 7 form the pump housing. An extended portion 30 of the casing cover 7 rotatably supports an axially extending shaft 11. An impeller 12 is attached to one end of the shaft 11. The shaft 11 is rotatably supported by front and rear journal bearing bushings 36 and 37.

The pumped fluid enters the eye or inlet 14 of the impeller 12 and is discharged at a higher pressure at the impeller discharge 15. The impeller has a plurality of radially spaced apart axially extending inlet vanes 16. A plurality of cooling flow return passageways 72 are located in the rear surface of the impeller 12. In the preferred embodiment shown in FIG. 1, the cooling flow return passageways 72 are located at a point where the pumped fluid pressure is intermediate between the suction pressure at the inlet 14 and the discharge pressure at the impeller discharge 15. The cooling flow return passageways 72 are located at a diameter greater than the diameter of the inlet vane tips 17. In other applications, for example, where the impeller eye has a larger diameter, the cooling flow return passages 72 may be located in a region which is at suction pressure.

Wear rings 43 are located about the periphery of the impeller 12 adjacent the eye 14 of the impeller and adjacent the back of the impeller. The wear rings 43 are typically a hardened material with a corrosive resistance similar to the material of the pump casing 1. The wear rings 43 ar designed to allow a small amount of leakage from the pump discharge 15 to the inlet 2 of the impeller and to regions 70 (mixing area) behind the impeller.

A magnet holder 50 is attached to the rear end of shaft 11. The magnet holder 50 has a hollow cylindrical shape with the end opposite the rear end of shaft 11 being open. The exterior surface of the magnet holder 50 carries a series of magnets 58 which rotate closely about the interior of a relatively thin can-shaped shell 59 which fits over the magnet holder 50 and the extended portion 30 of the casing cover 7. The shell 59 forms part of the pump housing and is part of the pump pressure boundary.

A power frame 48 fits over the shell 59 of the casing cover 7 and is attached to the pump casing 1 and casing cover 7 by a series of bolts. A drive shaft 49 is rotatably mounted in the power frame 48. The outer end of drive shaft 49 is connected to a driving device 45 using conventional coupling means. The driving device 45 is preferably an electric motor.

An outer magnet holder 46 is attached to the drive shaft 49. The outer magnet holder 46 has a hollow cylindrical shape open at one end. The outer magnet holder 46 carries a series of magnets 47 spaced around its interior surface which are magnetically coupled to the magnets 58 on the inner magnet holder 50 for transmitting torque from the driving device 45 to the pump impeller shaft 11.

The casing cover 7 contains a fluid passage 60 extending from its front face to a distribution chamber 62 for conducting a small portion of the pumped fluid from the pumping chamber 3 to the bearings 36, 37 and the inner magnet holder 46 and magnets 58. Distribution chamber 62 is an annular space bounded by bearings 36, 37, the shaft 11 and the extended portion 30 of the casing cover 7. This portion of the pumped fluid is used to lubricate the bearings 36, 37, to cool the bearings 36, 37 and to remove heat buildup in shell 59 caused by eddy current losses.

It is essential for the lubricating and cooling fluid to be free of particulate matter to provide the bearings with a long life. Therefore, it is desirable that particulate matter not pass into fluid passageway 60. Otherwise, particulate matter could lodge in the space between the bearings 36, 37 and the shaft 11, causing a buildup of particulate matter interfering with the operation of the pump, and possibly, damaging the bearings of the pump. Fluid passageway 60 opens into an annular pocket 61 in the front face of the casing cover 7 proximate the rear face of the impeller 12. The annular pocket 61 is also proximate the outer diameter of the impeller 12. A strainer or screen 63, of annular shape corresponding to the outline of the pocket 61, is placed over the top of the pocket 61 to capture particulate matter before it enters pocket 61 and fluid passageway 60.

From distribution chamber 62, the cooling fluid flow is divided into three portions, the first two portions flow in parallel through the bearings 36, 37 to provide lubrication and cooling. The third portion is used to cool the region of shell 59 which is heated by eddy current losses. This third portion enters a plurality of fluid bores 64 in an enlarged section of shaft 11. The fluid bores 64 are in fluid communication with an axially extending passageway 68 in the center of shaft 11. Axial passageway 68 directs the third portion of the cooling flow to the end of the shaft 11 adjacent the end of shell 59. From this point, the flow is past the inner magnets 58 and the adjacent shell 59 where the heat from eddy current losses is removed.

After cooling the shell 59, the third portion of the cooling flow mixes with the cooling flow from the rear bearing 37. The combined flow then enters restricting passageways 71 which direct the flow to mixing areas 70 where the flow is mixed with the return cooling flow from the front bearing 36 and the relatively cold (unheated) wear ring leakage flow. The diameter of the restricting passageways is approximately 0.25 inches.

This diameter is deliberately kept small such that the majority of the pressure drop in the third portion of the cooling flow (the shell 59 cooling flow) is across the restricting passageway 71. This keeps the pressure of the cooling flow in the vicinity of the shell 59 above the vapor pressure of the cooling fluid, thereby preventing any bubble formation or boiling of the cooling fluid as the eddy current loss induced heat is removed from the shell 59. For liquids with low vapor pressures, such as light hydrocarbons, an additional restricting orifice 73 may be added to the restricting passageway 71.

The return cooling fluid is mixed with the relatively cold wear ring leakage flow in mixing areas 70 to reduce the temperature of the fluid before being returned to the suction side of the impeller 12. Without the additional cooling, the return flow could flash causing cavitation in the impeller.

In the preferred embodiment, described above, the cooling fluid flow is divided into three parallel cooling flows, each of the two bearings and the shell. It is not necessary to cool the bearings in parallel. The majority of the heat removal is from the shell 59. The shell cooling flow must be parallel to the flow through the bearings. However, the bearings could be sequentially cooled by a single cooling flow, rather than by parallel cooling flows. Because the bearing cooling flow is parallel to the shell cooling flow, the bearings are lubricated with cool fluid, thereby minimizing the danger of flashing in the pump bearing area. Also, in the preferred embodiment, the cooling fluid flow is returned to an intermediate pressure. Because of mixing the cooling return flow with the wear ring leakage flow, it is possible to return the cooling fluid flow to pump suction pressure.

Having described the invention, what is claimed is:

1. A magnetically coupled centrifugal pump comprising:

a pump housing containing a pumping chamber and having an inlet and an outlet;

a shaft mounted in the pump housing for rotation;

a pump impeller attached to the forward end of the shaft for rotation with the shaft in the pumping chamber and a first magnetic means attached to the rear end of the shaft, the first magnetic means adapted to be magnetically coupled to a second magnetic means rotated by a rotary driving device, the shaft being mounted in at least two bearings spaced from each other along the length of the shaft and located between the impeller and the first magnetic means, the pump impeller having an inlet and a discharge; and a shell surrounding the shaft bearings and first magnetic means to seal the pump from the exterior and prevent the pumped fluid from leaking, the shell being located between the two magnetic means and being able to transmit magnetic forces between the two magnetic means for magnetically coupling the two magnetic means together;

the pump housing containing a passage for conducting cooling fluid from the discharge of the pump impeller to the bearings and the shell, the passage dividing the cooling fluid into at least two parts such that the cooling fluid cools the bearings and the shell in parallel.

2. The magnetically coupled centrifugal pump according to claim 1, wherein the cooling fluid is returned to an intermediate pressure area of the impeller located between the inlet of the impeller and the discharge of the impeller.

3. The magnetically coupled centrifugal pump according to claim 1, wherein the impeller has a plurality of radially spaced apart axially extending inlet vanes, the portion of a vane closest to the center of the impeller defining a vane tip; and the impeller having a plurality of cooling fluid return passages extending therethrough, the cooling fluid return passages being located at a diameter greater than the diameter of the inlet vane tips.

4. The magnetically coupled centrifugal pump according to claim 1, wherein the cooling flow is divided into three parts, the first part cooling at least one bearing, the second part cooling at least one other bearing, the third part cooling the shell, the second part and the third part being mixed together after cooling the at least one other bearing and the shell, the mixed second and third parts passing through a restricting passageway prior to mixing with the first part.

5. A magnetically coupled centrifugal pump comprising:

a pump housing containing a pumping chamber and having an inlet and an outlet;

a shaft mounted in the pump housing for rotation;

a pump impeller attached to the forward end of the shaft for rotation with the shaft in the pumping chamber and a first magnetic means attached to the rear end of the shaft, the first magnetic means adapted to be magnetically coupled to a second magnetic means rotated by a rotary driving device, the shaft being mounted in at least two bearings spaced from each other along the length of the shaft and located between the impeller and the first magnetic means, the impeller having an inlet and a discharge;

a wear ring being located between the impeller and the pump housing, the wear ring allowing leakage flow between the impeller and pump housing; and a shell surrounding the shaft bearings and first magnetic means to seal the pump from the exterior and prevent the pumped fluid from leaking, the shell being located between the two magnetic means and being able to transmit magnetic forces between the two magnetic means for magnetically coupling the two magnetic means together;

the pump housing containing a passage for conducting cooling fluid from the discharge of the pump impeller to the bearings and the shell, the passage dividing the cooling fluid into at least two parts such that the cooling fluid cools the bearings and the shell in parallel, the cooling fluid mixing with the wear ring leakage flow prior to being returned to the impeller.

6. The magnetically coupled centrifugal pump according to claim 5, wherein the cooling fluid is returned to an intermediate pressure area of the impeller located between the inlet of the impeller and the discharge of the impeller.

7. The magnetically coupled centrifugal pump according to claim 5, wherein the impeller has a plurality of radially spaced apart axially extending inlet vanes, the portion of a vane closest to the center of the impeller defining a vane tip; and the impeller having a plurality of cooling fluid return passages extending therethrough, the cooling fluid return passages being located at a diameter greater than the diameter of the inlet vane tips.

8. The magnetically coupled centrifugal pump according to claim 5, wherein the cooling flow is divided into three parts, the first part cooling at least one bearing, the second part cooling at least one other bearing, the third part cooling the shell, the second part and the third part being mixed together after cooling the at least one other bearing and the shell, the mixed second and third parts passing through a restricting passageway prior to mixing with the first part.

9. The magnetically coupled centrifugal pump according to claim 8, wherein the pump housing contains a fluid passage for directing the cooling flow from the pump discharge to a distribution chamber where the cooling flow is divided into the three parts and the pump housing contains a collection chamber wherein the mixed second and third parts of the cooling flow, the first part of the cooling flow and the wear ring leakage flow are mixed together.

10. The magnetically coupled centrifugal pump according to claim 9, wherein the shaft has an axially extending bore in fluid communication with the distribution chamber, the third part of the cooling flow flowing through this axially extending bore.

* * * * *

UNITED STATES PATENT AND TRADEMARK OFFICE

CERTIFICATE OF CORRECTION

PATENT NO. : 5,248,245

DATED : 09/28/93

INVENTOR(S) : BEHNKE et al.

It is certified that error appears in the above—identified patent and that said Letters Patent is hereby corrected as shown below:

On the title page, item [54]:

Change the title to --MAGNETICALLY COUPLED CENTRIFUGAL PUMP WITH IMPROVED COOLING AND LUBRICATION--

Column 1, lines 2-4, change the title to --MAGNETICALLY COUPLED CENTRIFUGAL PUMP WITH IMPROVED COOLING AND LUBRICATION--

Signed and Sealed this

Seventeenth Day of May, 1994

Bruce Lehman

*Attest:*

BRUCE LEHMAN

*Attesting Officer*

*Commissioner of Patents and Trademarks*